US006844547B2

(12) United States Patent
Syka

(10) Patent No.: US 6,844,547 B2
(45) Date of Patent: Jan. 18, 2005

(54) CIRCUIT FOR APPLYING SUPPLEMENTARY VOLTAGES TO RF MULTIPOLE DEVICES

(75) Inventor: John E. P. Syka, Charlottesville, VA (US)

(73) Assignee: Thermo Finnigan LLC, San Jose, CA (US)

( * ) Notice: Subject to any disclaimer, the term of this patent is extended or adjusted under 35 U.S.C. 154(b) by 51 days.

(21) Appl. No.: 10/357,725

(22) Filed: Feb. 3, 2003

(65) Prior Publication Data

US 2003/0173524 A1 Sep. 18, 2003

Related U.S. Application Data

(60) Provisional application No. 60/354,389, filed on Feb. 4, 2002, and provisional application No. 60/355,436, filed on Feb. 5, 2002.

(51) Int. Cl.[7] ..... H01J 49/00
(52) U.S. Cl. ..... 250/292; 250/290
(58) Field of Search ..... 250/292, 290, 250/291

(56) References Cited

U.S. PATENT DOCUMENTS 5,089,703 A 2/1992 Schoen et al.
5,302,826 A 4/1994 Wells
5,420,425 A 5/1995 Bier et al.
5,468,957 A 11/1995 Franzen
5,747,801 A * 5/1998 Quarmby et al. ..... 250/292
6,111,358 A 8/2000 Cardwell et al.

FOREIGN PATENT DOCUMENTS

WO 03/03495 4/2003

* cited by examiner

*Primary Examiner*—Kiet T. Nguyen
(74) *Attorney, Agent, or Firm*—Dorsey & Whitney LLP

(57) ABSTRACT

A circuit is described for applying RF and AC voltages to the elements or electrodes of an ion trap or ion guide. The circuit includes an RF transformer having a primary winding and a secondary winding. The secondary winding includes at least two filars. A broadband transformer adapted to be connected to a source of AC voltage applies AC voltage across the low-voltage end of two of the filars. Another broadband transformer connected to the filars at the high-voltage end provides a combined RF and AC output for application to selected electrodes. Also described is a circuit employing a multi-filar RF transformer and broadband transformers for applying RF and AC voltages to spaced rods of a linear ion trap. Also described is a circuit employing a multi-filar RF transformer and broadband transformers for applying RF and AC voltages to the electrodes in each section of a linear ion trap of the type having a center section and end sections, and different DC voltages to the electrodes in the end sections.

28 Claims, 11 Drawing Sheets

CIRCUIT FOR APPLYING SUPPLEMENTARY VOLTAGES TO RF MULTIPOLE DEVICES

RELATED APPLICATIONS

This application claims priority to provisional Application Ser. No. 60/354,389 filed Feb. 4, 2002 and Ser. No. 60/355,436 filed Feb. 5, 2002.

BRIEF DESCRIPTIONS OF THE INVENTION

This invention relates generally to RF (radio frequency) quadrupole and inhomogeneous field devices such as three-dimensional RF quadrupole ion traps and two-dimensional RF quadrupole mass filters or ion traps, and more particularly to a circuit which allows application of supplementary AC voltages to electrodes of RF quadrupole field devices when the voltages used to generate the main RF quadrupole field are simultaneously being applied to the same electrodes.

BACKGROUND OF THE INVENTION

There is a wide variety of RF quadrupole and multipole field devices used for mass spectrometry and related applications. These devices are used for containment, guiding, transport, ion fragmentation, mass (mass-to-charge ratio) selective sorting, and production of mass (mass-to-charge ratio) spectra of beams or populations of ions. Many of these devices are improved versions or variations of the RF quadrupole mass filter and the RF quadrupole ion trap originally described by Paul and Stienwedel in U.S. Pat. No. 2,939,952 (or more accurately in its German counterpart, DE 944 900). The ion trapping and sorting with these devices typically requires the establishment of a relatively intense RF or combined RF and DC electrostatic potential field having predominately a quadrupolar spatial potential distribution or at least one that varies approximately quadratically in one spatial dimension. These fields are established by applying appropriate RF voltages to electrodes shaped and positioned to correspond (at least approximately) to the iso-potential surfaces of the desired electrostatic potential field. Ions constrained in such quadratically varying potential fields have characteristic frequencies of motion which depend only on the intensity and frequency (assuming the RF portion of the field is sinusoidally varying) of the field and the m/z (mass-to-charge ratio—amu/#unit changes) of the ions.

From the earliest stages of the development of the RF quadrupole mass filter and the ion trap, it was realized that the superposition of smaller amplitude AC fields on the RF fields could be advantageous. For example, through careful choice of the frequency composition of these auxiliary fields, specific ion m/zs or m/z ranges could be resonantly excited or destabilized. Typically, these superposed fields are predominately dipolar or quadrupolar in their spatial variation. Early examples of the use of such fields would be the selective detection of ions trapped in a quadrupole ion trap via resonant power absorption, the ejection of specific trapped ion m/zs to an external detector, and selective elimination of abundant ion species from an ion beam transmitted through a mass filter. Auxiliary fields have also been used to selectively modulate a heterogeneous ion beam transmitting through a RF-only operated mass filter in order to create a mass spectrometer [U.S. Pat. No. 5,089,703]. Modern three-dimensional RF quadrupole ion trap mass spectrometers utilize such auxiliary fields to enable mass scanning, mass isolation, and fragmentation of ions [U.S. Re. No. 34,000, U.S. Pat. No. 5,182,451, EP 0336990,5, U.S. Pat. No. 5,324,939].

More recently there have appeared mass selective devices that have the characteristics of both the two-dimensional quadrupole mass filter and the three-dimensional quadrupole ion trap. Such devices are the RF quadrupole ring ion trap and the RF linear quadrupole ion trap. The RF quadrupole ring trap corresponds, in concept, to a two-dimensional quadrupole mass filter bent into a circle such so as to create an extended ion containment region. When used as a mass spectrometer, it is operated in a manner very similar to the conventional three-dimensional quadrupole ion trap. The linear quadrupole trap is a essentially a two-dimensional quadrupole mass filter with a provision to superpose a weak DC potential to provide a trapping field along the axis of the device. These devices may be operated as stand alone mass spectrometers [U.S. Pat. Nos. 4,755,670, 6,177,668]. They also are utilized as ion accumulation devices ahead of RF three-dimensional ion traps, time-of-flight [U.S. Pat. Nos. 5,689,111, 6,020,586] and FT-ICR (Fourier Transform Ion Cyclotron Resonance) mass spectrometers. In more sophisticated hybrid tandem mass spectrometer instruments these devices are used as a first mass analyzer effecting stages of ion accumulation, ion isolation and ion fragmentation before transfer of fragment ions to either a time-of-flight [U.S. Pat. No. 6,011,259] or FT-ICR analyzer for a final stage of mass analysis.

This invention is motivated by and directed to the difficulties presented in applying the auxiliary AC voltages on to the electrodes of a RF linear quadrupole ion trap. However its range of applicability is much broader, as the approach outlined here may be used to superpose auxiliary fields of a variety of spatial geometries on to a main RF field of conventional three-dimensional quadrupole ion traps, RF quadrupole ring ion traps, RF linear quadrupole traps and other inhomogeneous RF field devices where it may be desirable to add auxiliary voltages on to high RF voltage and apply the composite voltages to an electrode.

FIG. 1 shows an example of an electrode structure of a linear quadrupole ion trap, which is known from the prior art. The quadrupole structure includes two pairs of opposing electrodes or rods, the rods having a hyperbolic profile to substantially match the iso-potentials of a two-dimensional quadrupole field. Each of the rods is cut into a main or central section and two end sections. The DC potentials applied to the end sections are elevated relative to that of the central section to form a "potential well" to constrain positive ions axially. An aperture cut into at least one of the central sections of one of the rods is provided to allow trapped ions to be selectively ejected in a direction orthogonal to the central axis in response to AC dipolar electric fields. In this figure, as per convention, the rods pairs are aligned with the x and y axes and are therefore denoted as the X and Y rod pairs. The individual sections of the rod electrodes will be denoted by rod and segment. In the following, the individual rod segments are denoted as X1F-X2F, Y1F-Y2F, X1C-X2C, Y1C-Y2C and X1B-X2B, Y1B-Y2B. For example, the Front, Center and Back sections of the X1 rod are thus denoted as X1F, X1M, and X1B respectively.

FIGS. 2*a*–2*c* schematically show the voltages needed to operate the linear ion trap shown in FIG. 1 as a mass spectrometer. These voltages include three separate DC voltages, DC1, DC2 and DC3, to produce the injection and axial trapping fields (FIG. 2*a*), two phases of primary RF voltage to produce the radial trapping fields (FIG. 2*b*), and, two phases of AC resonance excitation voltage for isolation, activation and ejection of the ion(s) (FIG. 2*c*). The necessary combination of the above voltages results in nine separate voltages applied to twelve electrode sections.

A two-dimensional RF quadrupole field is established in the x and y direction by applying a sinusoidal RF voltage, $2V_{RF}$ Cos(ωt), between the X and Y rod electrode pairs. For most practical devices, the range for angular frequency, ω, of the applied voltage typically corresponds to frequencies of between 0.5 to 2.5 MHz. The amplitude of this main trapping field voltage, $V_{RF}$, may typically range to exceed 4 KV peak voltage during ion isolation and scanning steps of mass spectrometric experiments. While it is feasible to accomplish this by applying a RF voltage $2V_{RF}$ Cos(ωt) to only one pair of rod electrodes while maintaining the other pair at RF "ground", this imposes a RF potential at the axis of the device (bias potential) of $V_{RF}$ Cos(ωt). While this has no effect on ion motion once the ions are within the device, this RF axis potential leads to strong z axis RF potential gradients at the entrance to the device which interfere with the injection of ions from an external source. Symmetric application of voltages $V_{RF}$ Cos(ωt) and $-V_{RF}$ Cos(ωt) to the X and Y rod pairs respectively minimizes the axis potential. However this means that to create the desired superposition of RF, DC and AC fields within the device, corresponding RF, DC and AC voltages must be simultaneously applied to at least some of the electrodes.

In order to enable the superposition of a weak axial DC trapping potential upon the main two-dimensional quadrupole field, each of the four rod electrodes may be divided into segments so as to allow separate DC bias voltages, $V_{DC_FRONT}$, $V_{DC_CENTER}$, $V_{DC_BACK}$, to be applied to the rod segments comprising the Front, Center and Back sections of the structure. These DC rod bias or offset voltages are typically under ±30 volts relative to the instrument "ground" potential. Generally, the voltage difference between center section and end sections needs to be at least a few hundreds of millivolts to effect ion trapping, however voltage differences of 1 to 15 volts are more typically used. In this embodiment of a linear quadrupole ion trap, an auxiliary voltage, $2V_{AUX}(t)$ must also be applied between the X1 and X2 rods so as to create a substantially dipolar electrostatic field directed along the x axis. Again, as with the main RF trapping voltages, to avoid creating an AC potential on the central axis, its associated z axis voltage gradients at the end of the device, and additionally to avoid creating a substantial AC quadrupole field component, voltages $V_{AUX}(t)$ and $-V_{AUX}(t)$ are applied to the X1 and X2 rods respectively. In this example, the Y1 and Y2 rod electrodes are maintained at AC "ground" (0 volts AC). The functional form of this applied auxiliary AC voltage will depend upon the particular stage of the particular mass spectrometric experiment being performed. In some instances the auxiliary voltage will be sinusoidal and have an angular frequency which will typically be within the range from 0.1×ω/2 to ω/2. At other stages of an experiment, the auxiliary AC voltage may be a broadband waveform that will likely be composed of angular frequencies ranging from 2π×10 kHz to ω/2. The amplitude of this auxiliary AC voltage may range from under 1 volt when it is a sinusoidal (single frequency) wave form, to more than 100 volts when it is a broadband (multi-frequency) wave form. The total voltage applied to the electrode segments will then be the superposition of three voltages. Below are listed the voltages applied to each rod electrode segment.

| Electrode Segment | Voltage |
|---|---|
| X1F | $V_{X1F} = V_{RF}Cos(\omega t) + V_{DC_FRONT} + V_{Aux}(t)$ |
| X1C | $V_{X1C} = V_{RF}Cos(\omega t) + V_{DC_CENTER} + V_{AUX}(t)$ |
| X1B | $V_{X1B} = V_{RF}Cos(\omega t) + V_{DC_BACK} + V_{AUX}(t)$ |
| X2F | $V_{X2F} = V_{RF}COS(\omega t) + V_{DC_FRONT} - VAUX(t)$ |
| X2C | $V_{X2C} = V_{RF}Cos(\omega t) + V_{DC_CENTER} - VAUX(t)$ |
| X2B | $V_{X2B} = V_{RF}Cos(\omega t) + V_{DC_BACK} - VAUX(t)$ |
| Y1F | $V_{Y1F} = -V_{RF}Cos(\omega t) + V_{DC_FRONT}$ |
| Y1C | $V_{Y1C} = -V_{RF}Cos(\omega t) + V_{DC_CENTER}$ |
| Y1B | $V_{Y1B} = -V_{RF}Cos(\omega t) + V_{DC_BACK}$ |
| Y2F | $V_{Y2F} = -V_{RF}Cos(\omega t) + V_{DC_FRONT}$ |
| Y2C | $V_{Y2C} = -V_{RF}Cos(\omega t) + V_{DC_CENTER}$ |
| Y2B | $V_{Y2B} = -V_{RF}Cos(\omega t) + V_{DC_BACK}$ |

In this particular case, the voltages applied to each X rod electrode segment are unique superpositions of the RF, DC and AC voltages. However, as no AC voltage is applied to the Y rod electrodes, delete in this example the voltages applied to the Y rod segment pairs Y1F-Y2F, Y1M-Y2M and Y1R-Y2R are unique only to each pair.

In operation, ions are either formed in or introduced into the volume between the central electrodes. When ions are introduced, the DC voltages on the electrodes of sections X1F-X2F and Y1F-Y2F can be used to gate the ions into the trap volume. After the ions are introduced into the ion trap, different DC voltages are applied to the electrodes of both the front (F) and back (B) sections than that applied to the electrodes of the center section (C) such that ions are trapped in the center section. RF and DC trapping voltages are applied to opposite pairs of electrodes to generate a substantially uniform quadrupolar field such that ions over the entire mass-to-charge range of interest are trapped within the trapping field. Ions are mass selectively ejected from the ion trap by applying a supplemental AC voltage between the X pairs of electrodes of the sections while ramping the main RF amplitude. This supplemental AC voltage generates an electric field which causes ions to be excited or to oscillate with increasing amplitude until they are ejected through the aperture and detected by a detector, not shown.

This current invention is directed to methods and apparatuses for generating voltage superpositions like those shown above and required to operate the linear ion trap. In particular, this invention is directed to an improved circuit for combining an AC voltage with the RF voltage for RF quadrupole and multipole mass filters or ion traps, and more particularly to a circuit which allows the application of AC voltages to the electrodes of RF quadrupole field devices when the AC and RF voltages are simultaneously being applied to the same electrodes.

To explain the problem with existing methods and apparatus one needs to discuss the basic method from the prior art used to simultaneously apply the RF and AC voltages to the rod electrodes. FIG. 3 shows the conceptual schematic of a conventional apparatus for applying the RF and AC voltages to a two-dimensional quadrupole electrode structure. In this example, the rod electrodes are not divided into segments, therefore simplifying our example. However, the basic schemes for applying the RF and AC voltages to the electrodes does not change if the rod electrodes are segmented. FIG. 3 indicates how the X electrode pair AC voltages are combined with the X electrode RF voltage. The RF voltage source 21 drives the primary winding of the tuned circuit RF transformer 22 to produce the X and Y rod high RF voltages at the end connection points of secondary winding 22 of tuned circuit RF transformer 23. The AC voltage source 24 drives the primary winding of AC transformer 25 producing a differential AC voltage across the center tapped secondary winding of AC transformer 25. The high X rod RF voltage connection point of the secondary winding 22 of the RF transformer is connected to the center tap of the secondary winding of AC transformer 26 to add the desired of high X rod RF voltage to the opposing phases of AC voltages produced at the ends of the secondary winding of the AC transformer. The opposing ends of the AC transformer 26 secondary winding are connected correspondingly opposing X rod electrodes and the high Y rod voltage connection point of the RF transformer 23 is connected to both Y rod electrodes. The design requirements for the broadband transformer AC coupling transformer 26 are such that it needs to provide reasonably uniform AC voltage coupling and transformation between its primary and secondary windings over a wide frequency range (about 10 kHz to beyond 500 kHz, assuming $\omega=2\pi\times1{,}000$ kHz). If broadband multi-frequency AC waveforms are to be used, the amplitude of the voltage across the transformer secondary, $2V_{AUX}$, may exceed 150 volts. Although this approach has been successfully used, in many cases a major disadvantage of this approach is that the primary input of the AC transformer 26 is near "ground" potential and the secondary is floated at the RF voltage. Consequently, the primary and secondary windings to the broadband AC transformer must be sufficiently insulated such that the maximum RF voltage applied to the electrodes, $V_{RF_MAXIMUM}$, can be withstood without voltage breakdown or significant RF power dissipation in the transformer. For a high performance/high voltage system, $V_{RF_MAXIMUM}$ may approach 5,000 volts. All of this RF voltage is dropped between the primary and the secondary windings of the AC transformer The bandwidth and output voltage requirements for the broadband AC transformer may readily be met using a conventional transmission line type transformer wound on a high permeability toroidal ferrite core and which has modest size (about 2"×2"×1.5"). The additional constraint of having very high RF voltage isolation between the primary and secondary windings greatly complicates the design of such a device and requires a much larger and substantially more expensive AC transformer design.

OBJECTS AND SUMMARY OF THE INVENTION

It is an object of the present invention to provide an improved circuit for applying combinations of AC and RF voltages to the electrodes of quadrupole field devices such as two- and three-dimensional RF quadrupole ion traps and two-dimensional mass filters.

It is a further object of the present invention to provide a circuit for applying combinations of AC, RF and DC voltages to quadrupole field devices which overcomes the problems associated with coupling of AC voltages to the RF and DC voltages encountered in the prior art.

It is another object of the present invention to provide a circuit for coupling auxiliary AC voltages on to RF voltages which avoids the problems of coupling with a broadband transformer based scheme of the prior art.

There is provided a circuit for applying RF and AC voltages to the rods or electrodes of an ion trap or guide comprising an RF transformer having a primary winding and a secondary winding having at least two filars, said secondary winding having a lower RF voltage at one connection point (tap) than at other connection points (output taps), a first AC transformer having a primary winding and a secondary winding, the ends of said secondary winding each connected to separate filars at the low voltage connection point of the RF transformer secondary winding, a second AC transformer having a primary winding with its ends connected to the other end of said filars at the high voltage connection point of said RF transformer secondary winding and a (AC) secondary winding having its ends adapted to connect to electrically isolated electrodes of said ion trap or guide whereby combined RF and AC voltages are applied to the electrodes.

DESCRIPTION OF PREFERRED EMBODIMENTS

Figure 1:
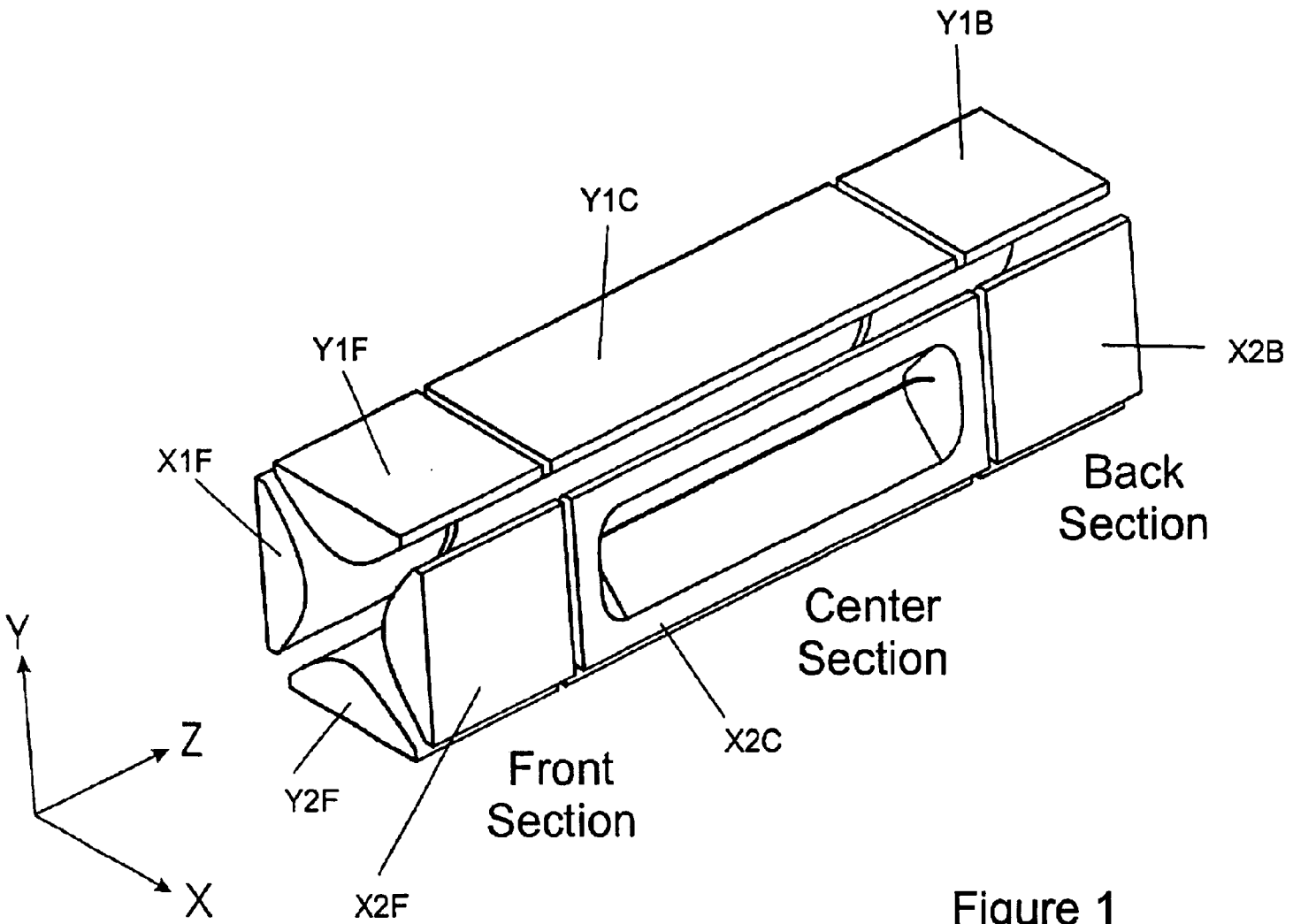
FIG. 1 is a representation of a linear quadrupole ion trap.
Figure 2A:
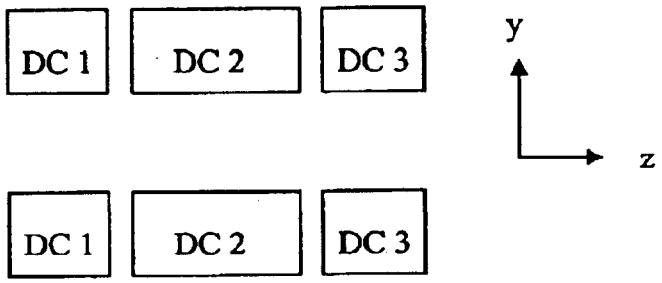
FIGS. 2*a*–2*c* illustrate the DC, AC and RF voltages necessary for operation of the two-dimensional ion trap shown in FIG. 1.
Figure 2B:
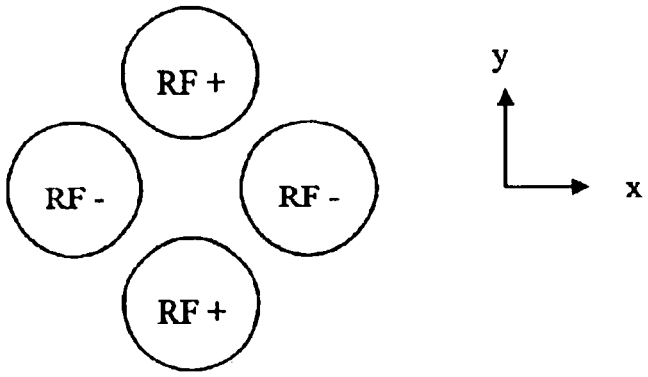
Figure 2C:
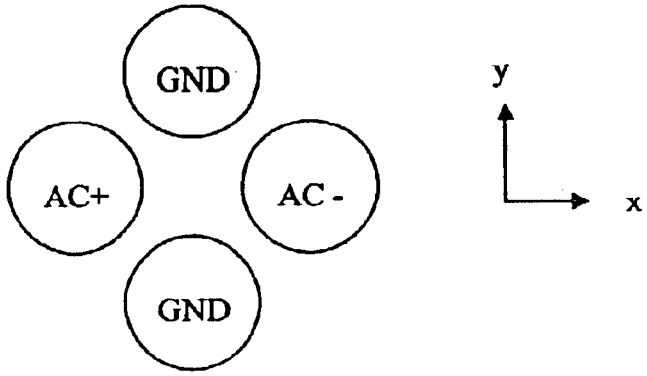
Figure 3:
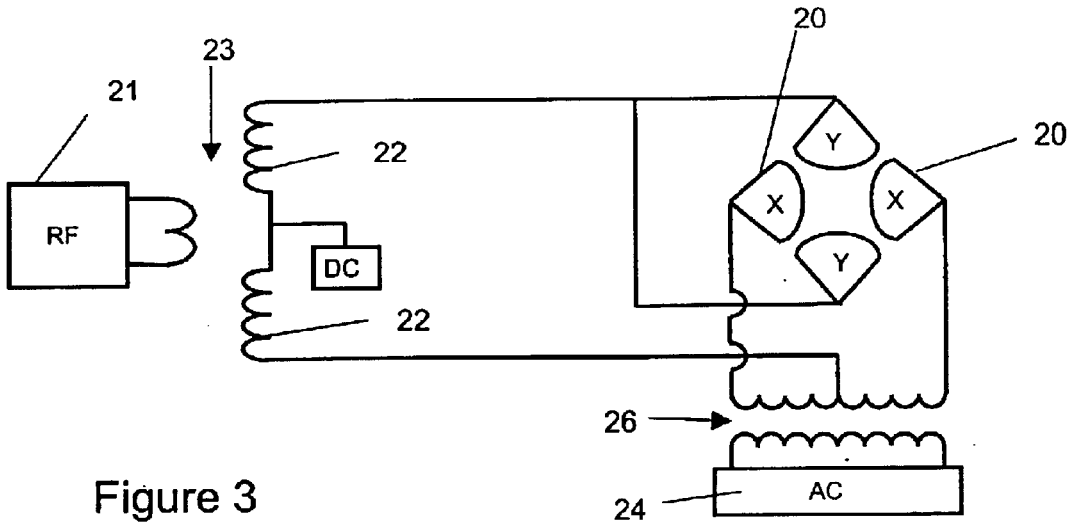
FIG. 3 schematically shows a prior art circuit for applying RF and AC voltages to the electrodes of an ion trap.

A brief discussion of the design and construction of RF tuned transformers 23 is helpful in the understanding of the present invention. The reason that such devices are used is that it is possible to generate high RF voltages in the frequency range needed for RF quadrupole/multipole devices with relatively modest amounts of RF power. The secondary winding of the transformer is, in essence, a very large air cored solenoidal inductor. The connection of the secondary winding to the rod electrodes puts an almost purely capacitive reactance across this inductor creating an LC resonant circuit. Since there is essentially no resistive component to this load the only source of damping is the resistance of the wire in the coil windings and resistive losses associated with induced currents in the circuit enclosure. Hence this LC circuit has a very high quality factor, Q, and a correspondingly narrow resonant bandwidth. A basic characteristic of such circuits is that if you drive them within their resonant band they produce a large voltage response. It is this property which is utilized to create a very efficient means of RF voltage transformation. The primary of the transformer 23 in FIG. 3 is simply a few isolated turns wrapped around the center region of the solenoidal secondary windings or alternatively interspersed between turns of the secondary solenoid in the central region of the coil. When a RF voltage at the resonant frequency of the tuned circuit is applied to the primary winding of the transformer, inductive coupling drives the secondary winding of the transformer and a much larger RF voltage develops across this winding. Resonant transformers allow voltage transformation ratios ($V_{RF_SECONDARY}/V_{RF_PRIMARY}$) of well greater than 100. Such voltage transformation ratios are not feasible using conventional broadband ferrite cored RF transformers. The quality factors, Qs, for the tuned circuit transformers used on high performance mass spectrometers may approach or exceed 200. This enables generation of RF voltages, $2V_{RF}$, of greater than 10,000 volts with RF power amplifiers that deliver less than 100 watts of RF power. This is necessary in order to construct high voltage/high performance RF quadrupole field mass spectrometers having acceptable size, power consumption and cost.

Multi-filar tuned circuit transformer coils may be constructed in many ways, for example: on helically grooved poloycarbonate tube coils, the individual filars wound against each other to create a single multifilar wire bundle in the grooves of the coil form; by winding a custom made twisted mutli-filar wire bundle onto a helically grooved coil form; by using mutli-stranded braid of magnet wires or some other wires with thin insulation; or by using very thin coaxial cable. While using a helically grooved coil form is convenient for hand winding coils, smooth tubes or arrays of rods made of material that does not absorb RF power could also be used. The examples given above are considered exemplary and other alternative constructions may be employed in practicing the current invention.

Figure 4A:
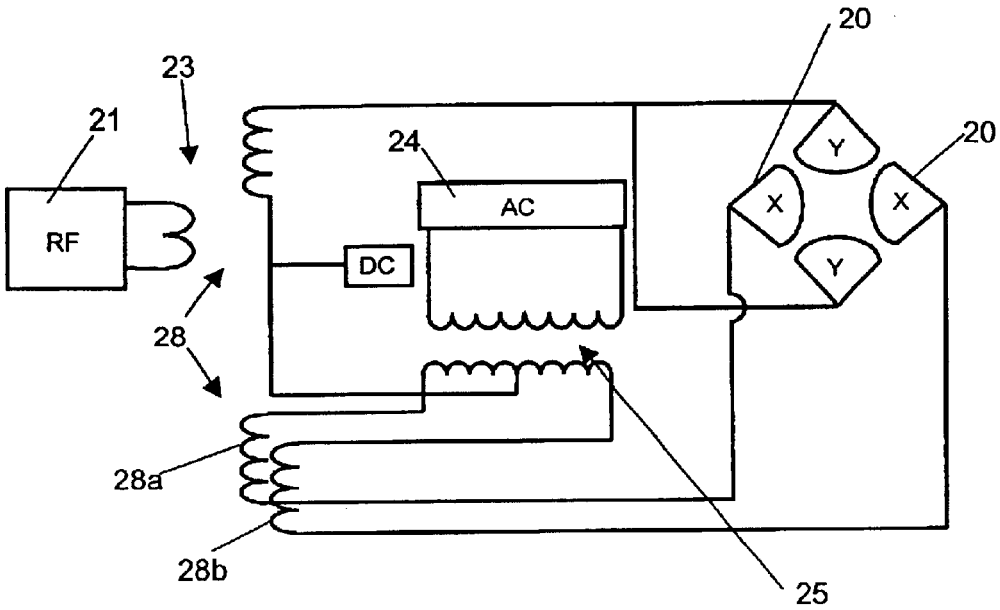
FIG. 4*a* schematically shows a conceptual embodiment of the invention for combining an AC voltage to an RF drive voltage to drive the X rod.
Figure 4B:
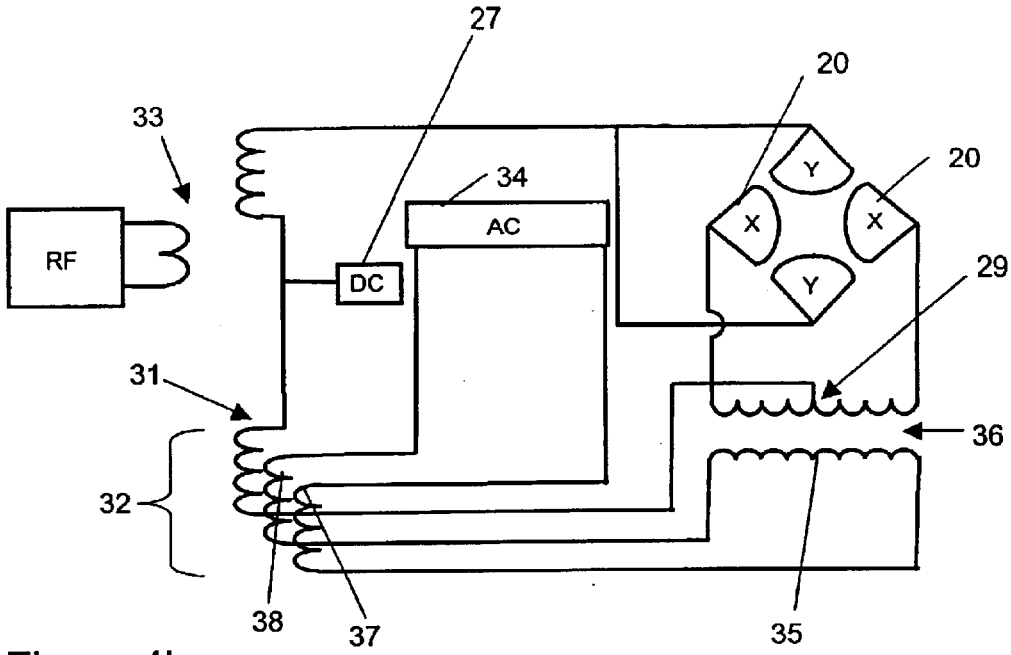
FIG. 4*b* schematically shows another conceptual embodiment of the invention for combining an AC voltage to an RF drive voltage to drive the X rod.
Figure 5:
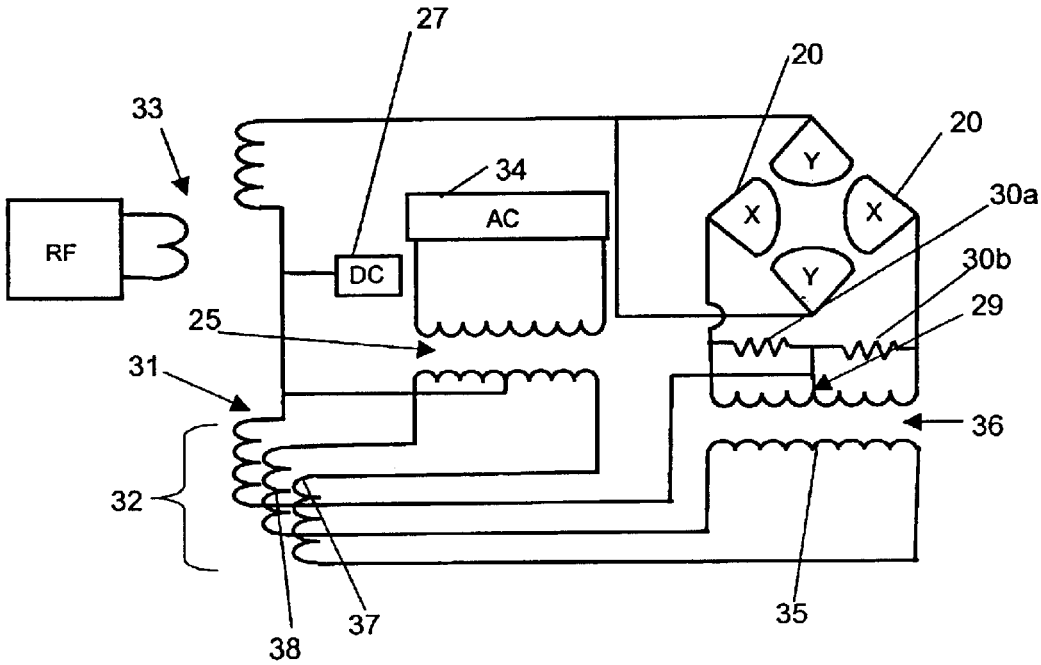
FIG. 5 is a schematic diagram of yet a further conceptual embodiment of the invention for combining an AC voltage to an RF drive voltage to drive the X rod.

The invention will first be described with reference to the conceptual schematics of FIGS. 4*a*, 4*b*, and 5. It should be noted that FIGS. 4*a*, 4*b* and 5 show only those apparatus components which are the most important to illustrate the invention. Those skilled in the art will be familiar with other required or optional components, which therefore do not need to be particularly illustrated or mentioned. In addition, it will be appreciated that although DC supplies are illustrated throughout the current invention, these may, if applicable, be replaced by DC "ground" connections.

FIG. 4*a* illustrates an embodiment of the invention, in which the problems of coupling the AC at the high voltage side of the RF transformer 23 are avoided by coupling the AC at the low voltage connection point of the RF transformer/coil. This configuration requires the use of multiple filars or windings 28 on the main RF coil with the AC voltage being applied across two filars 28*a*, 28*b*. As illustrated, and preferably, a broadband transformer 25 couples the AC supply voltage across the two filars 28*a*, 28*b*. This method of coupling the AC voltage on to the filars does not interfere with flow of RF current through the RF transformer secondary. Other equivalent methods of coupling are feasible and known to those skilled in the art. This particular embodiment has limitations because the AC supply must now drive the ion trap electrode load through the distance of the secondary windings of the RF coil. The filar windings 28*a*, 28*b* of the RF tuned transformer generally constitute a low characteristic impedance (under 100 Ω) two wire transmission line. The combination of a large miss-match between the largely reactive (capacitive) terminating impendence and the preferred terminating impedance of the windings 28*a*, 28*b* will likely cause a substantial non-uniformity in the propagation of the higher frequency components in the AC supply waveform voltage through the RF coil windings. Load resistors of appropriate value could placed across the connections to the X electrodes 20 so as to swamp the capacitive load they present to the AC circuit and provide the appropriate terminating impedance. This would greatly improve the uniformity of the frequency response of the AC over the desired bandwith. However the power required to drive such a low load impedance limits the amplitude of the AC voltage actually imposed between the X electrodes 20 to values too small for when broadband frequency waveforms are required, as broadband waveform applications require higher AC voltage amplitudes in order to get adequate power into all frequency components necessary for ion ejection.

A second alternative arrangement which similarly avoids the problems of coupling at the high voltage side of the RF transformer is illustrated in FIG. 4*b*. This arrangement again introduces DC 27 and AC 34 voltages on to the low voltage connection point 31 of the multi-filar transformer section 32 of RF transformer 33. Again, these voltages are transferred through the RF transformer section 32 to the high voltage side of the RF transformer section 32 and an AC voltage is transmitted to the primary 35 of an AC broadband transformer 36 via filars 37 and 38. The DC 27 is transmitted through to a center tap 29 on the secondary of the AC transformer 36 through filars 32. This approach also can create a large miss-match between the terminating impendence and the preferred terminating impedance of the RF coil winding filars 37 and 38 which may cause a substantial non-uniformity in the propagation of the higher frequency components in the AC supply waveform voltage through the coil windings. Again, load resistors of appropriate value could placed across the connections to the X electrodes 20 so as to swamp the capacitive load they present to the AC circuit and provide the appropriate terminating impedance. However utilization of the transformer 36 as an impedance transformer allows use of much higher load resistances between the X electrode connections and while still presenting an appropriately low terminating impedance at the high RF voltage ends of filars 37 and 38. This then allows much higher AC voltages to be imposed between the X electrodes 20 for a given amount of AC power dissipated.

A preferred arrangement which avoids the problems of coupling at the high voltage side of the RF transformer and the impedance matching issues is illustrated in FIG. 5. This arrangement introduces the DC 27 and the AC 34 voltages into the low voltage side 31 of the multi-filar transformer section 32 of RF transformer 33. As illustrated, and preferably, a broadband transformer 25 both voltage transforms the AC supply voltage and couples it across the two filars 37 and 38 at the low voltage connection point of the x side of the tuned RF transformer coil 32. The resulting AC voltage output by this first AC transformer 25 is then transferred through the RF transformer 33 to the high voltage side of the RF transformer 33 via filars 37 and 38. Preferably, the AC voltage is further transformed after transmitting to the RF high voltage end of the X side of the RF coil 32 by a second broadband AC transformer. The high voltage ends of filars 37 and 38 drive the primary 35 of the AC broadband transformer 36. This configuration again allows the use of relatively high valued resistors 30*a* and 30*b*, across the X electrodes 20 while still properly terminating the transmission line comprised of filars 37 and 38, thus allowing for uniformity in the propagation of the higher frequency components in the AC supply waveform voltage through the RF coil secondary winding. The introduction of voltage transformation or voltage gain though the first AC transformer 25 allows the AC voltage source 34 to drive an impedance other than that which is presented at the low RF voltage connection to filars 37 and 38. This increases the ratio between the amplitude of the AC voltage applied between the X electrodes and that output by the AC voltage source 34 thus reducing the required maximum voltage that the AC voltage source 34 needs to deliver.

Figure 6:
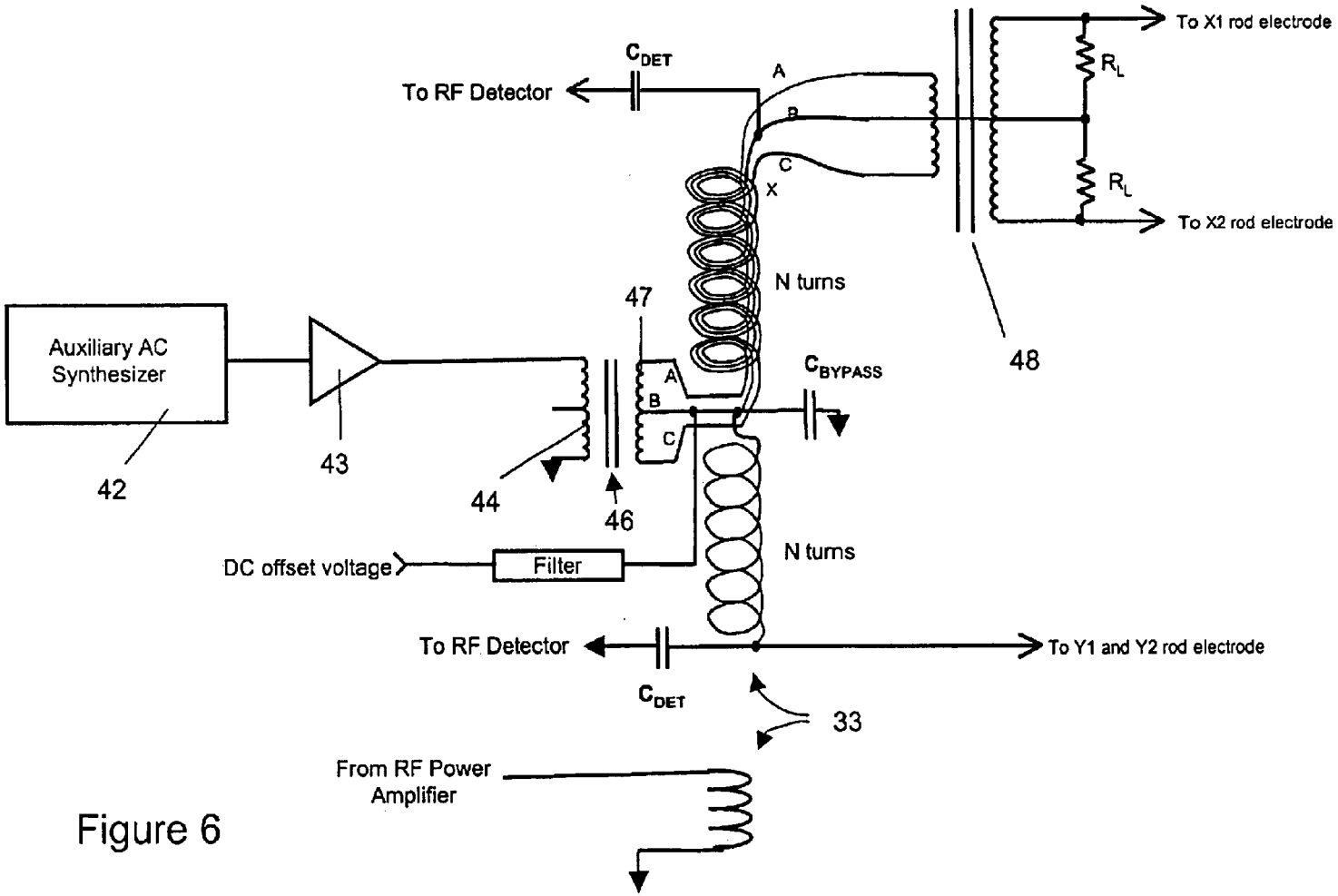
FIG. 6 is a detailed circuit diagram of the circuit according to FIG. 5.

A detailed description of the conceptual embodiment illustrated by FIG. 5 now follows. Referring to FIG. 6, the X side of the secondary of the tuned RF transformer 33 is used as the means for combining the auxiliary AC voltage and the RF voltage. A low voltage reference version of the desired AC voltage waveform is generated by an auxiliary AC synthesizer 42. This low voltage AC waveform is in turn amplified with a broadband amplifier 43. The output of this amplifier drives the primary 44 of an AC broadband transformer 46. However, the secondary 47 of this AC broadband transformer is not connected to the high RF voltage end of the X side of RF tuned circuit transformer secondary. Instead it is connected to the low RF voltage end of the X side of the RF tuned circuit transformer secondary. The X side of the RF tuned circuit transformer secondary is now constructed as a tri-filar winding with the windings labeled A, B and C, so as to create three identical but insulated X side windings that substantially behave in terms of the RF circuit as one winding. The ends of the secondary 47 of broadband transformer 46 are connected to the A and C filars of the X side of the RF transformer secondary at the low RF voltage connection point (end). The center tap of the secondary of broadband transformer 46 is connected to both the B filar of the low voltage end of the X side of the RF transformer secondary and the low voltage connection point (end) of the Y side of the RF transformer secondary. Thus a differential version of the AC voltage waveform is imposed between the A and C filars, with the B filar acting as a sort of AC "ground". The center tap of the secondary of broadband transformer 46 is also the place where the DC offset voltage is connected to the circuit, thus DC biasing all of the secondaries of the tuned RF transformer. This point is maintained near RF "ground" by connecting it to ground through a bypass capacitor, $C_{BYPASS}$. The value of $C_{BYPASS}$ needs to be chosen such that it is large enough so that its reactance is small in comparison to the reactance of the RF tuned transformer secondary, and yet not so large that it detrimentally effects the rate at which the DC bias voltage can be changed during an experiment. This means that $C_{BYPASS}$ is typically on the order 5,000–10,000 pF. Depending on the specific physical implementation of the circuit, a $C_{BYPASS}$ may be unnecessary. The RF currents flowing in the A and C filars of the X side of the secondary of the RF tuned circuit transformer will be nearly identical, therefore the secondary windings of broadband transformer 46 will present a negligible reactance for these currents. Thus, at the low voltage end of the X side of the secondary of the RF tuned circuit transformer, all three filars will be maintained near RF "ground". Since the three filars of the X side of the RF tuned circuit secondary winding are essentially identical, RF voltage is equally coupled on to them. Thus, at the high end of the X side of the RF tuned circuit, all three filars have the same RF voltage, $V_{RF}$, and DC voltage, $V_{DC}$ but differing AC voltages. The A and C filars drive the ends of the primary winding of a second broadband AC transformer 48. The ends of the secondary winding of broadband transformer 48 are in turn connected to X1 and X2 rod electrodes thus applying the final voltage transformed version of the AC voltage waveform, $2V_{AUX}(t)$, between the rod electrodes. To provide the appropriate load impedance, a pair of identically valued load resisters, $R_L$, which are connected in series are also connected across the ends of the secondary of broadband transformer 48. The B filar of the X side of the RF tuned circuit secondary is connected to the center taps of both the primary and secondary windings of broadband transformer 48, and the interconnection point between the two load resistors. This circuit node corresponds to an AC "ground" which is "floating" on the combined RF and DC voltage, $V_{RF}\ \mathrm{Cos}(\omega t)+V_{DC}$. This makes it the ideal place to sample the RF voltage amplitude. A connection is therefore made from this node to the RF detection circuitry through a precision RF detector capacitor, $C_{DET}$. This "floating". AC ground arrangement also insures that the AC voltages applied to the X1 and X2 rod electrodes are the equal and opposite voltages corresponding to $V_{AUX}(t)$ and $-V_{AUX}(t)$ which are required to generate the desired dipole auxiliary field.

Broadband transformer 48 is necessitated by the requirement that the maximum amplitude of $V_{AUX}(t)$ be allowed to exceed 100 volts and the fact that the tri-filar X winding of the RF tuned transformer constitutes a low characteristic impedance (under 20 Ω) three wire transmission line (a pair of differentially driven wires and shield wire). The length of the X windings may easily be on the order of 30 meters. Depending on the dielectric constant of the insulation between filars, such a length could easily be on the order of ⅛ of a wavelength for frequencies in the upper end of the bandwidth of the auxiliary voltage waveform. A large mismatch between the terminating impendence (load resistance) and the characteristic impedance of the X winding three wire transmission line would cause a substantial non-uniformity in the propagation of the higher frequency components in the auxiliary waveform voltage through the coil winding. As the DC resistance of the individual filars are on the order of 6 Ω, terminating this transmission line at its characteristic impedance is also undesirable as it would result in an unacceptable attenuation in the AC waveform voltage during its transmission to the high RF voltage end of the winding. Fortunately, since the frequency band of interest only barely extends into the domain where these effects are significant, adequate uniformity of frequency response and acceptable attenuations can be obtained with a terminating impedance of about 50–60 Ω. Broadband transformer 48 provides the necessary impedance matching between the desired 50–60 Ω terminating impedance for X winding transmission line and a sufficiently high load impedance such that a modest amount of AC power will be required to generate the desired maximum auxiliary voltage waveform amplitudes. Transformation ratios of 2/1, 3/1 and 4/1 (corresponding to impedance transform ratios of 4/1, 9/1 and 16/1) are readily achieved if broadband transformer 48 is constructed as a conventional high permeability ferrite cored transmission line transformer. Such transformers are relatively small (ca. 2"×2"×1.5") and are not expensive to construct. Since the entire transformer is "floated" at $V_{RF}$, there is neither the voltage isolation problem nor the added capacitance problem associated with the broadband coupling transformer of the prior art. Assuming a 50 Ω terminating impedance and a 3/1 voltage transformation ratio with broadband transformer 48, application of a 100 Volt auxiliary voltage between the X1 and X2 rod electrodes will result in a dissipation of about 11 watts of power in the load resistors.

This is very manageable in regards to both power dissipation in the circuitry and the size and cost of the AC amplifier needed to deliver this power. It should also be noted that if the AC Amplifier is able to drive low impedances, the broadband transformer 36 may be wound to provide impedance matching and voltage transformation (boost) at the input end of the X winding transmission line. In some applications no DC voltage may be required, so a DC "ground" may be substituted for it. In some case adequate performance may be obtained without the use of the AC "ground" filar, B.

Figure 7:
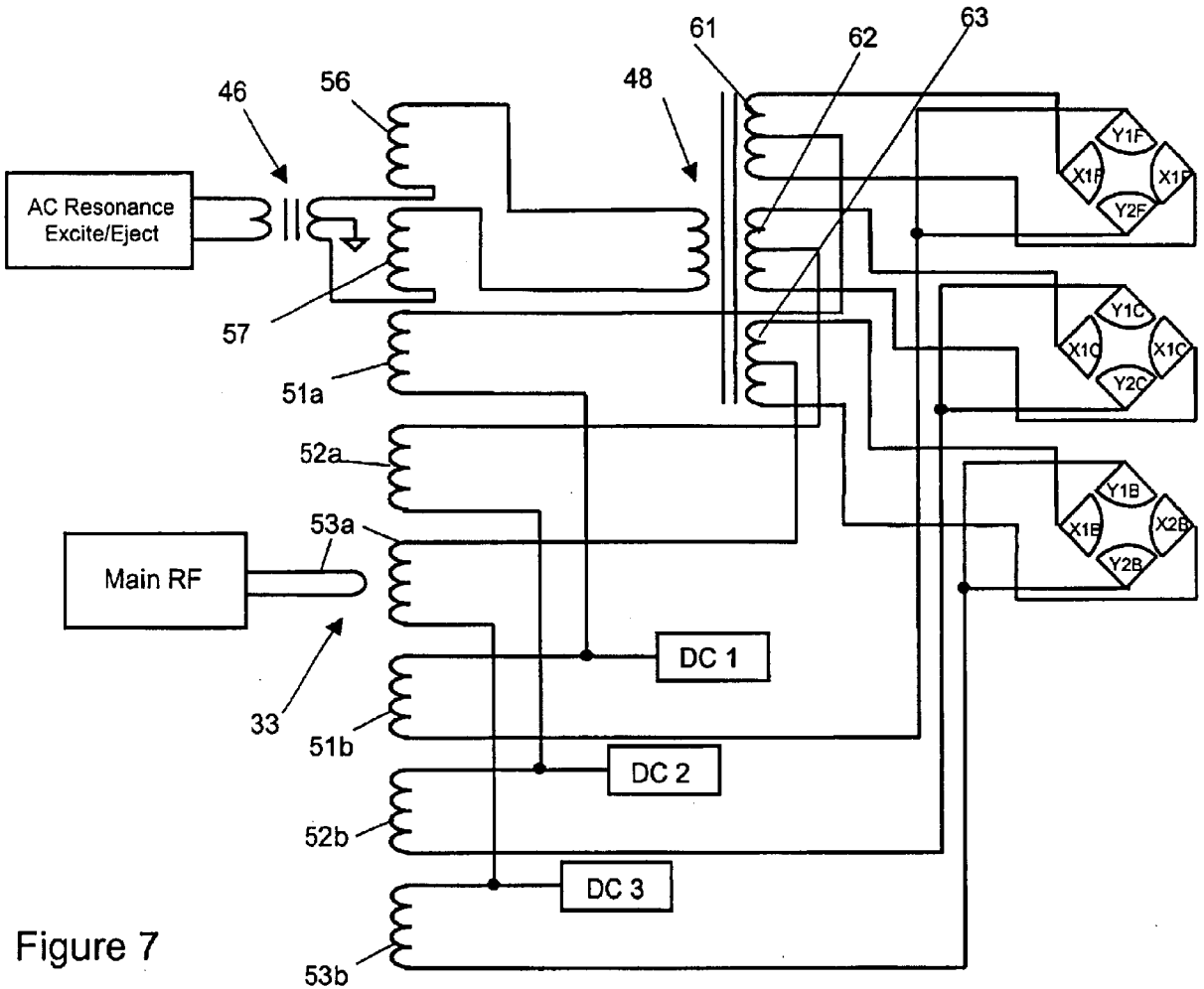
FIG. 7 schematically shows circuit diagram of still a further conceptual embodiment configured to drive the segment rods of a segmented quadrupole structure.

To this point the discussion of the prior art and the invention have been limited to the case where the rod electrodes have a single segment, as would be the case for a mass filter or linear ion trap with plate lenses adjacent to the rod ends which are biased to provide the axial trapping field. However, the invention can be readily adapted to the case where the rod electrodes are divided into segments. FIG. 7 shows schematically a conceptual embodiment of the invention whereby the appropriate superpositions of the auxiliary AC, RF and DC voltages are generated for a linear quadrupole trap whose rod electrodes are divided into three segments. The circuit includes an RF air core transformer 33 having a primary winding, and a multi-filar secondary winding. As depicted in FIG. 7, the X side of the RF transformer secondary winding comprises five filars 56, 57, 51*a*, 52*a*, and 53*a*. The Y side of the RF transformer secondary winding of the RF transformer is comprised of three filars 51*b*, 52*b*, 53*b*. The RF transformer's center tap is near RF "ground" and the filars joined at the center tap, 51*a*, 51*b*; 52*a*, 52*b*; 53*a*, 53*b* are connected to the DC voltages DC1, DC2, DC3 respectively. The other connection points, the ends of the RF transformer secondary winding, are at high RF voltage generated for application to the X and Y rod segments to provide the trapping fields. The AC or excitation voltage is coupled between the low RF voltage connection points of the X side RF transformer secondary winding filars 56 and 57 by a first AC transformer 46. The high voltage connection points of the RF transformer X side filars 56 and 57 are connected to the primary windings of a second AC transformer 48 which has center tapped identical secondary windings 61, 62 and 63. The high voltage connection points of the X side RF transformer secondary winding filars 51*a*, 52*a*, 53*a* are connected to the center taps of this 2nd AC transformer's secondary windings, 61, 62, and 63, respectively and thus also DC biasing them with voltages DC1, DC2 and DC3 respectively. The ends of this second AC transformer's secondary windings 61, 62, 63 are connected across the X rod segment pairs X1F, X2F; X1CX2C; and X1B, X2B, respectively. The ends of the Y side of the RF transformer secondary winding filars 51*b*, 52*b*, and 53*b* connect to the YF, YC and YB rod electrode segment pairs respectively. The corresponding secondary winding ends of the second AC transformer are connected to segments of the same multi-segment X rod, thereby insuring that the same a AC voltage phase is applied to all segments of each multi-segment X rod and that the opposing X rods have equal amplitude and opposite phase AC voltages imposed on them. The opposing ends of each secondary winding of the second AC transformer are connected to opposing segments of the X rods. The filar connected to each center taps of each second transformer secondary winding corresponds the Y filar connected to the Y rod segments adjacent to the X rod segments connected to the ends of the same second transformer secondary. Thus all the rod segments of each section of the structure are biased at the same DC offset potential. All windings of the second transformer are "floated" at a common high RF voltage and phase thus imposing the same RF voltage to all X rod segments. Since all filars emanating from the high voltage end of the Y side of the RF transformer have a common RF voltage (opposite in phase and nearly identical in amplitude from those emanating from the high voltage end of the X side of the RF transformer secondary), a RF voltage opposite in phase and nearly equal in amplitude to that imposed on the X rods is imposed on the Y rods. Thus all of the desired DC, AC and RF voltage superpositions are created and imposed on the 12 electrode segments of a three segment linear quadrupole trap.

Figure 8:
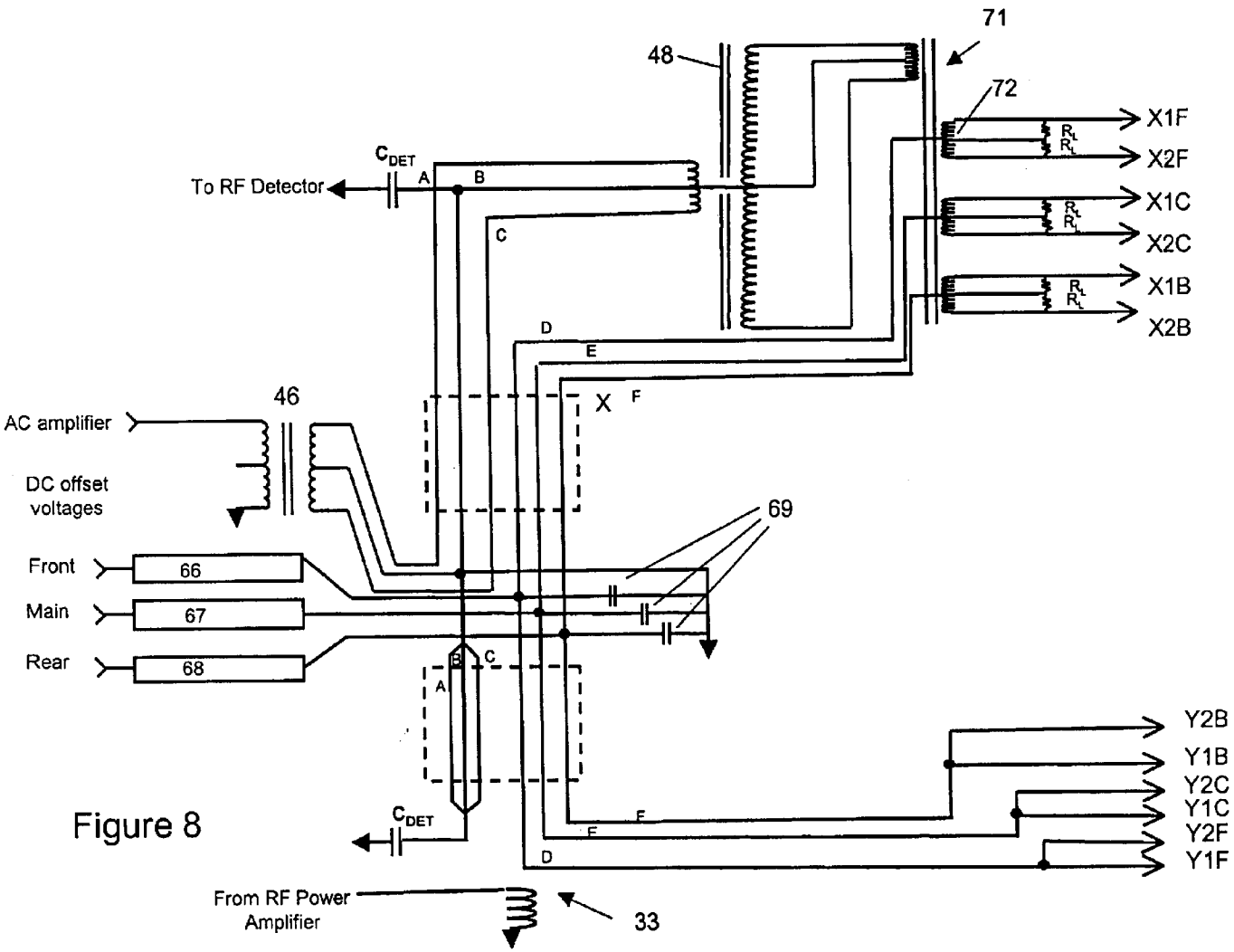
FIG. 8 is a detailed circuit diagram of the circuit according to FIG. 7.

A detailed description of the conceptual embodiment illustrated by FIG. 7 now follows. Referring to FIG. 8, the number of filars comprising the secondary winding of the RF tuned circuit transformer have been increased to six and are labeled A, B, C, D, E, F. On the X side of the transformer, the A, B, and C filars correspond in function to the filars A, B, and C in FIG. 6. The AC amplifier (not shown) again drives the primary winding of a first broadband AC transformer 46. As before, the ends of the secondary winding of broadband transformer 46 are connected to the A, and C filars of the X side of the RF tuned circuit secondary at its low voltage end (center tap). Also as before, the center tap of the broadband transformer 46 is connected to the B filar of X side of the RF tuned circuit secondary at its low voltage connection point (center tap). However, in the depicted implementation, the center tap of the broadband transformer 46 is connected to ground rather than a DC bias voltage. Thus the A, B, and C filars on the X side of the tuned circuit transformer coil are all biased at DC "ground" potential. The A, B, and C filars of the Y side of the RF tuned circuit transformer coil secondary are also tied to DC "ground". The DC offset voltages for the Front, Center and Back rod electrode sections are fed through RF blocking filters 66, 67 and 68 to bias the D, E and F filars of both the X and Y sides of the RF tuned circuit transformer secondary winding at the low voltage point of the secondary winding (center tap). To insure that the low voltage ends of the RF tuned transformer secondary halves are maintained close to RF "ground", the D, E and F filars are connected to ground though bypass capacitors 69. Just as before, at the high voltage end of the X side of the RF tuned circuit secondary, the A, and B filars drive the primary winding of second AC broadband transformer 48. Again, the B filar connects to the center taps of both the primary and the secondary of this second broadband transformer 48. At the high voltage ends of this transformer's secondary windings the B filar also serves as the feed-back source for the RF voltage amplitude regulation servo loop and therefore is connected to the RF detector circuit though a precision capacitor, $C_{DET}$. This second broadband transformer 48 serves as a voltage/impedance transformer whose outputs feed the primary winding of a third AC broadband transformer 71. Transformer 71 is used to couple the auxiliary voltage generated at the outputs broadband transformer 48 on to the DC offset voltages carried by the D, E and F filars. Transformer 71 has three identical secondary windings 72, and the fully transformed auxiliary voltage is coupled identically on to all of them. The center taps of these three secondary windings are each driven by one of the DC voltage carrying filars (D, E and F). The desired superpositions of the RF, AC and DC voltages appear at the ends of these secondaries. The transformer secondary windings 72 are connected to the appropriate rod electrode segments as indicated in the drawings. A pair of load resistors $R_L$ are connected across each of the three secondaries 72 of broadband transformer 71 to provide uniformity of amplitude response with frequency. Since both the primaries and secondaries of these two broadband transformers 48, 71 are floated at high RF voltage, there are none of the voltage isolation problems associated with the prior art approach. While, conceivably, the functions of broadband transformer 71 and broadband transformer 48 could be combined in one transformer it is preferred to attain the desired functions of voltage transformation and AC to DC coupling with two transformers wound on separate ferrite cores.

On the high voltage end the Y side of the RF transformer, the D, E, and F filars are connected directly to the appropriate Y rod electrode segments as they already have the desired superpositions of RF and DC voltage. Also at the high voltage end of the Y-side of the coil, the A, B, C filars are connected together and to the Y side RF detector capacitor to provide feedback of the Y electrode RF voltage amplitude to the RF voltage amplitude control loop. On the Y side of the tuned RF transformer the A, B and C filars could be replaced by a single filar. However, from a manufacturing standpoint it would probably be easier to use the same multi-filar wire on both sides of the RF transformers secondary winding.

The schemes for generating the necessary superpositions of RF, DC and AC voltages for a three segment two-dimensional RF quadrupole ion trap illustrated in FIGS. 7 and 8 can be extended or modified in various other ways. One simple extension of this design would be the case where the trap is divided into four segments. The expedient way of modifying the circuitry to accommodate the extra segment would be to disconnect the ground connection of the B filar of the RF tuned transformer secondary winding and drive it with an additional DC voltage supply through an additional filter and then simply connect the primary connections of broadband transformer 71 to the added segments of the X1 and X2 rods. Alternatively, a seventh filar could be added to the RF tuned transformer secondary winding with a corresponding secondary winding added to broadband transformer 71.

Figure 9:
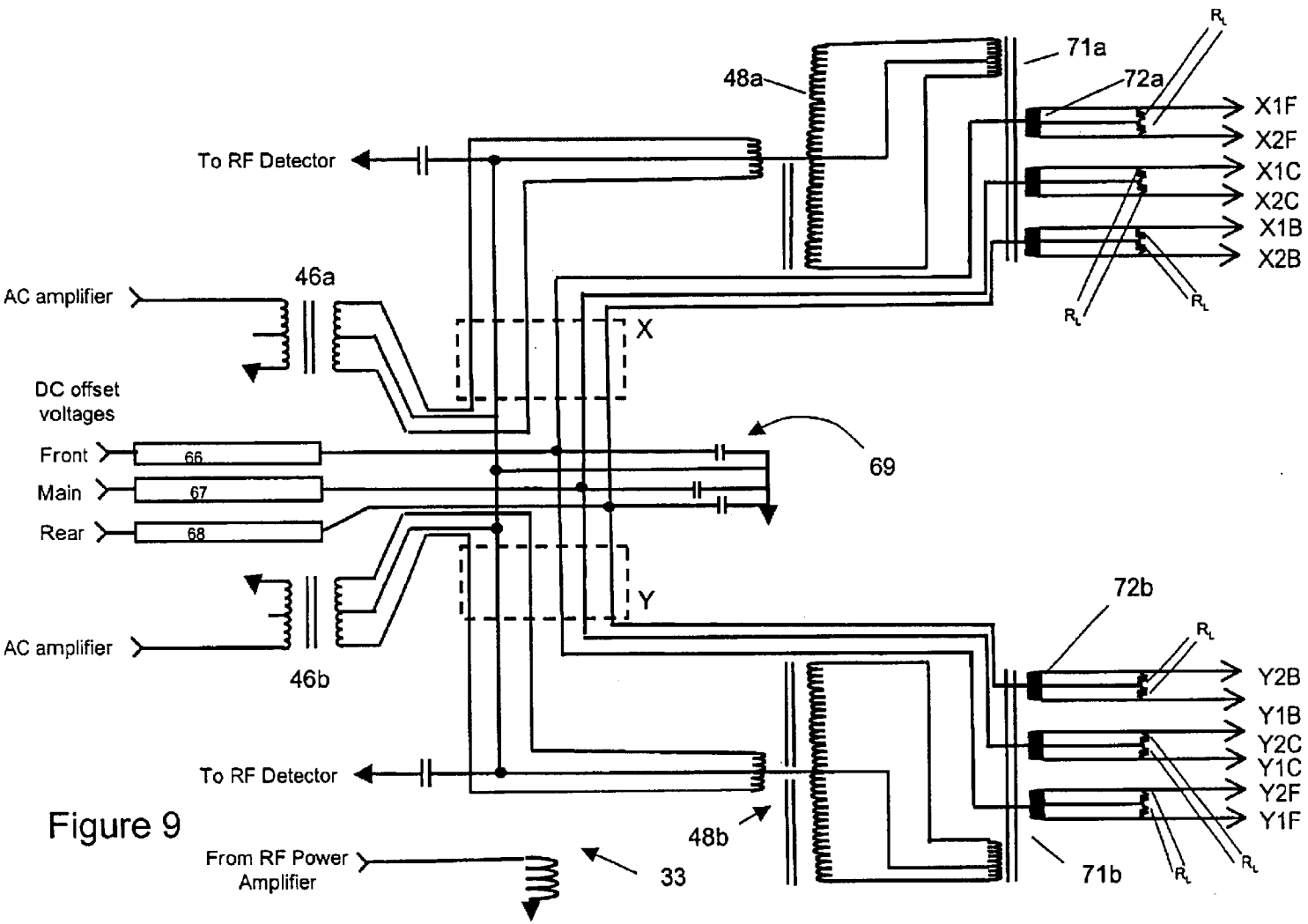
FIG. 9 is an embodiment of the invention in which separate auxiliary voltages are coupled to the X and Y rod electrodes of a segmented quadrupole electrode structure.

Another very likely extension to the scheme shown in FIG. 8 would be the case where a second independent dipole field oriented in the Y dimension is also desired. This can be straightforwardly accomplished by making the circuitry on the Y sides of the RF tuned transformer secondary winding a replicate of that on the X side of the winding. FIG. 9 shows one way this may be accomplished. The same DC supplies and filters 66, 67, 68 are used for both X and Y sides of the RF transformer coil as the X and Y rods in each segment are equally biased. However, this is not inherent to the invention, certainly separate and different DC voltages may be applied to the X and Y rod electrode in any particular segment. There are dedicated X and Y auxiliary waveform AC amplifiers, broadband transformers 46, 46*a*, broadband transformers 48*a*, 48*b*, and broadband transformers 71*a*, 71*b* and associated load resistors 72*a*, 72*b*. The function of the subunits remain unchanged.

Figure 10:
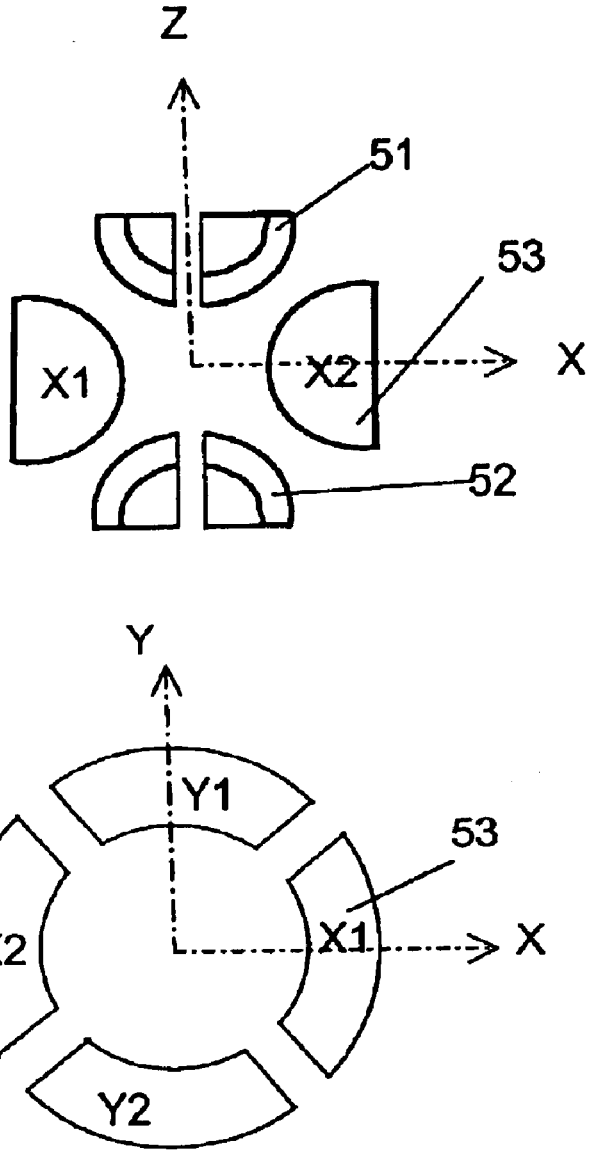
FIG. 10 is a schematic diagram of a three-dimensional ion trap having a segmented ring electrode.

A different application of the invention would be the case were different auxiliary voltages would need to be applied to segments of the same electrode and therefore need to be combined with the same high RF voltage. One example of where one would want to do this is when one wants to independently excite the x and y dimensional modes of oscillation (radial modes) of trapped ions within a three-dimensional RF quadrupole ion trap of the type having end caps 51 and 52 and a ring electrode 53, FIG. 10. This would entail the superposition of separate dipole fields respectively polarized in the x and y dimensions on to the main three-dimensional RF quadrupolar trapping field. Since in these devices, ions from an external source or ionizing electrons are typically introduced through one of the end cap electrodes, the RF voltage, $V_{RF}$ Cos(ωt), is typically applied to only the ring electrode. Both the end cap and ring electrodes are biased at a common DC potential, $V_{DC}$. One approach to accomplishing the superposition of the two auxiliary fields in an ion trap in accordance to the invention is shown schematically in FIG. 10. The ring electrode 53 is divided into four equal and electrically isolated segments. These segments are designated in clockwise order as Y1, X1, Y2 and X2. The same RF voltage, $V_{RF}$ Cos(ωt), is applied to all of the ring electrode segments. To create approximate x and y polarized auxiliary dipole fields, voltages $2V_{AUX_X}(t)$ and $2V_{AUX_Y}(t)$ are applied differentially between the corresponding opposing segments of the ring electrode. Below are listed the voltages applied to each segment of the ring electrode.

| Ring Electrode Segment | Voltage |
|---|---|
| X1 | $V_{X1} = V_{RF}\text{Cos}(\omega t) + V_{DC} + V_{AUX_X}(t)$ |
| X2 | $V_{X2} = V_{RF}\text{Cos}(\omega t) + V_{DC} - V_{AUX_X}(t)$ |
| Y1 | $V_{Y1} = V_{RF}\text{Cos}(\omega t) + V_{DC} + V_{AUX_Y}(t)$ |
| Y2 | $V_{Y2} = V_{RF}\text{Cos}(\omega t) + V_{DC} - V_{AUX_Y}(t)$ |

Figure 11:
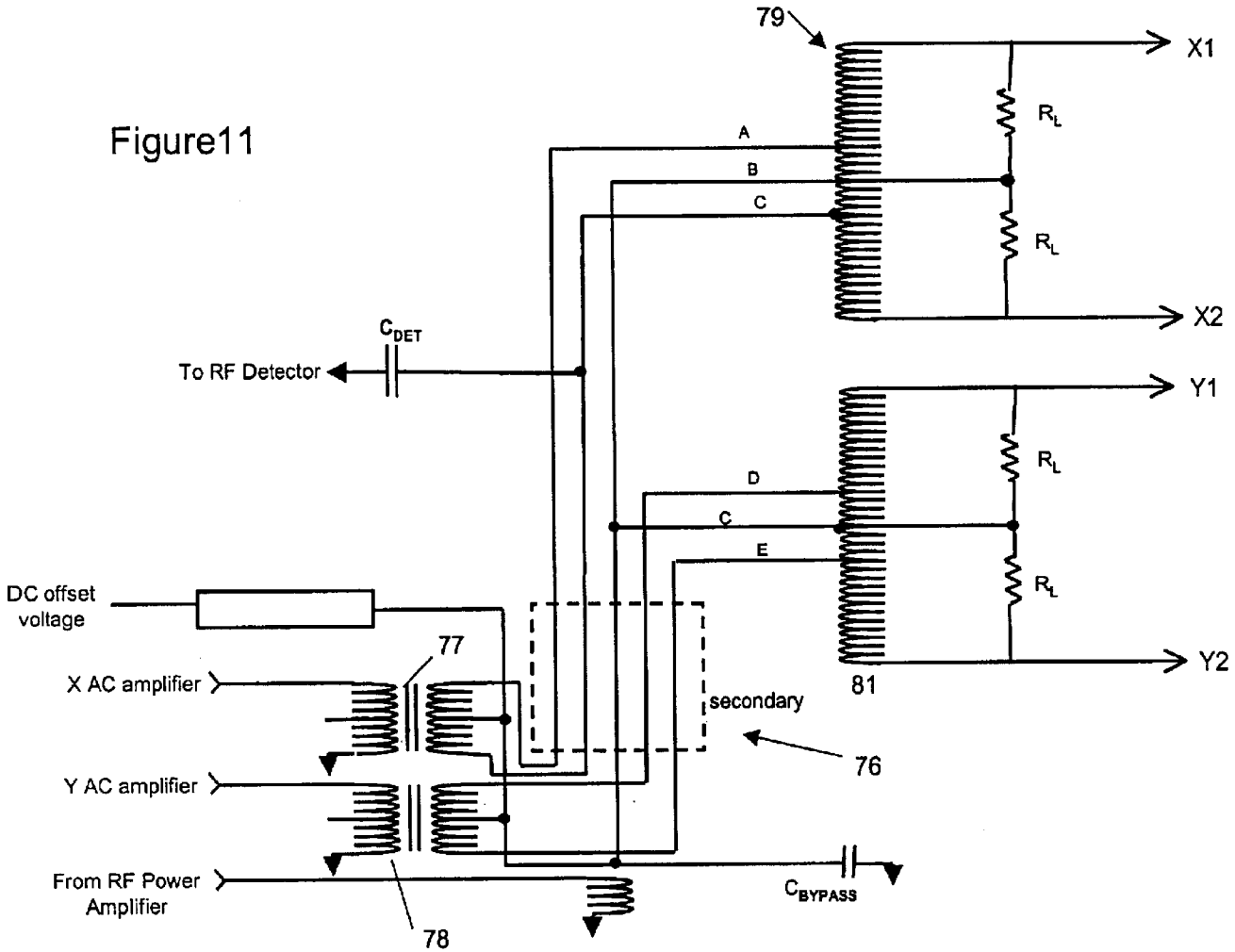
FIG. 11 is a schematic circuit diagram of an embodiment of the invention for applying dipole voltages to the segments of the ring electrode.

A suitable circuit for applying RF, AC and DC voltages to the Ring electrode segments is shown in FIG. 11. Since the RF voltage is applied only to the Ring electrode, the secondary winding of the multi-filar tuned circuit RF transformer 76 is a continuous winding and not divided into halves. It is constructed as a five filar winding. Filars A and B carry the x dimension auxiliary AC power and filars D and E carry they dimension auxiliary AC power. The C filar corresponds to the AC "ground" for these auxiliary voltages. As before, the auxiliary voltages are coupled on to filars of the secondary winding of the tuned RF transformer at the low RF voltage end (tap) of the winding by broadband transformers. Broadband transformer 77 couples the X AC voltage between filars A and B and broadband transformer 78 couple the Y AC voltage between filars D and E. Center taps of the secondaries of these two transformers 77, 78 are connected together, and to the C filar of the RF transformer secondary winding. The DC voltage to bias the ring electrode (DC offset voltage) is brought through a RF blocking filter and is also connected to the center taps of these broadband transformers thus biasing all the filars of the RF tuned transformer secondary winding. The low RF voltage end of the RF tuned transformer secondary is connected to system "ground" through a bypass capacitor, $C_{BYPASS}$. In this case, since the secondary is only single sided (rather than differential as in the previously described embodiments), a considerable amount of RF voltage will appear on the low voltage side of the RF tuned transformer secondary. The magnitude of this voltage is approximately given as $V_{RF}xC_{TRAP}/C_{BYPASS}$, where $C_{TRAP}$ is the capacitance between the ring and end cap electrodes. $C_{TRAP}$ and $C_{BYPASS}$ are typically on the order of 50 pF and 5,000 pF respectively. This means that several tens of volts of RF can appear at this point. As this RF voltage appears essentially equally at the all outputs of both broadband transformers 77 and 78, minimal RF voltage (or power) is coupled across these transformers and into the respective AC amplifiers. On the high RF voltage side (connection point) of the RF tuned transformer secondary, the A and B filars connect to the primary inputs of broadband transformer 79 and the D and E filars connect to the primary inputs of broadband transformer 81. The C filar connects to the center tap inputs of both of these transformers. The C filar also provides the feedback for the RF voltage amplitude control loop as it is connected to the RF detector circuitry though a RF detector capacitor, $C_{DET}$. The outputs of broadband transformer 79 and broadband transformer 81 are connected to the X1, X2 and Y1, Y2 ring electrode segment pairs. As before, a pair of load resistors $R_L$ are connected in series across the outputs of these transformers with their connection point connected to the center tap of the transformer. In this embodiment the broadband transformer 58 and broadband transformer 59 are configured as auto-transformers. This illustrates that there is not just one way to construct the transformers to accomplish the desired AC voltage/impedance transformation.

Figure 12:
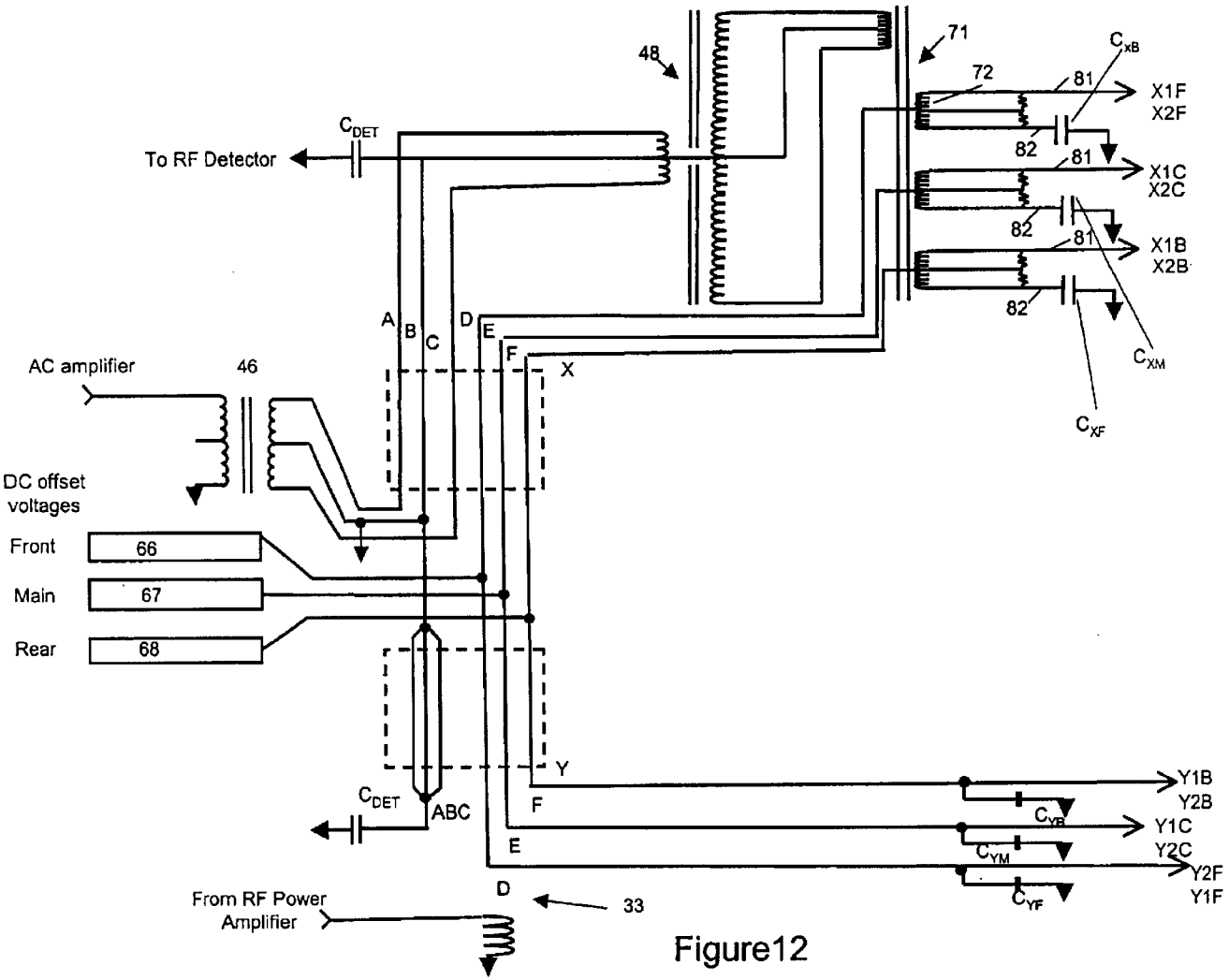
FIG. 12 is a schematic diagram of another circuit incorporating the present invention for driving the electrodes of a segmented two-dimensional ion trap such that an auxiliary AC quadrupole field is superposed on the main RF quadrupole field.

The previously described embodiments of the invention have been directed to creating the necessary voltage combinations for superposing dipolar AC auxiliary fields upon RF quadrupole field devices. The invention is in no way restricted to the superposition of AC dipole fields on to RF quadrupole fields. FIG. 12 shows an embodiment of the invention which produces the necessary voltage combinations to superpose an auxiliary AC quadrupole field on the RF quadrupole field of a three segment two-dimensional quadrupole ion trap. The circuit in FIG. 12 is identical to that of FIG. 8 and bears the same reference numbers except in the terminating connections to the various rod segments. Only one terminal 81 of each secondary winding of broadband transformer 71 is connected to the corresponding device segment of both the X1 and X2 rod electrodes. The other terminal 82 of each secondary winding is connected to balancing capacitors whose other terminals are connected to "ground". These are denoted as $C_{XF}$, $C_{XC}$, and $C_{XR}$. These capacitors insure that a balanced amount of RF current flows through each side of each secondary winding 72 of broadband transformer 71 resulting in no net magnetization of the transformer core. Thus broadband transformer secondary windings 72 present a near zero impedance for RF currents and therefore the AC circuit load resistors $R_L$ are removed from the RF current path. This added capacitance on the X side of the RF tuned transformer resonant circuit is matched by adding corresponding amount capacitance on the Y side of the RF tuned transformer circuit in order to maintain the symmetry of the RF voltages on the X and Y rod electrodes. This balancing capacitance to "ground" is provided by $C_{YF}$, $C_{YM}$, and $C_{YR}$. These added capacitances do increase the resonating capacitance of the RF tuned circuit making it less power efficient. However, in practice, acceptable performance has been obtained with such a circuit without using any of the balancing capacitors. This is probably due to the substantial amount of capacitance between the primary and secondary windings of transmission line type transformers. This provides alternative RF current paths to the rod electrode segments that are not through the load resistors for the auxiliary AC circuit.

In the various example shown above, when multiple DC voltages are involved, a tuned RF voltage transformer filar is dedicated for each DC voltage and separate filars are used for the AC voltage. It should be noted that with additional circuitry and different transformers at the low voltage and high voltage ends of the RF tuned transformer it is feasible that the AC and DC voltages could be carried on the same filars. This would allow a 3 filar RF tuned circuit transformer to supply the three DC voltages and auxiliary AC voltages for a three segment two-dimensional quadrupole ion trap. Such a design would be in accordance with the invention. However, the added complexity of the circuitry at the terminal ends of the RF transformer coil would likely outweigh the advantages afforded by having a RF transformer coil with fewer filars. It should also be noted that in the above descriptions the RF tuned transformer is comprised of separate primary and secondary windings. However in many instances RF tuned transformers constructed as auto-transformers (where the primary and secondary windings partially share common conductors) would serve equivalently and the use of such transformers would be wholly within the scope of the invention.

While the previous examples have been restricted to applications related to two and three-dimensional RF quadrupole field devices, the invention is more broadly applicable and could be used with higher order RF multipole ion guides (hexapole, octopoles), RF ring traps and various other RF inhomogeneous field ion trapping, guiding and sorting devices. The invention is useful where the superposition of auxiliary AC voltage on potentially high RF voltages of the magnitude and frequencies used for these types of apparatuses is required on at least one electrode (or electrode segment) of such a device.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A circuit for applying RF and AC voltages to electrodes of a RF inhomogeneous field device comprising:

an RF transformer having a primary winding, and a secondary winding coupled to said primary winding, said secondary winding having at least two electrically isolated filars upon which RF voltage couples substantially identically, and said secondary winding having a low RF voltage connection point and a high RF voltage connection point, a source of AC voltage connected between said at least two filars of the RF secondary windings at the low-voltage connection point of said RF winding, said filars supplying the combined RF and AC voltages to at least one electrode of the inhomogeneous RF field device.

2. A circuit as in claim 1, wherein said filars supply the combined RF and AC voltages to at least two electrodes.

3. A circuit as in claim 1, further comprising at least a first AC transformer connected between said at least two filars.

4. A circuit as in claim 3, wherein said AC transformer is connected to said filars at the low RF voltage connection point of the RF secondary winding.

5. A circuit as in claim 3, wherein said AC transformer is connected between said filars at the high RF voltage connection point of the RF transformer's secondary winding.

6. A circuit as in claim 4, further comprising at least a second AC transformer connected between said at least two filars at the high RF voltage connection point of the RF transformer's secondary winding.

7. A circuit as in claims 3, 4, 5 or 6 in which the at least one of the AC transformers is an auto-transformer.

8. A circuit as in claim 6 in which said first AC transformer has a primary winding for connection to a source of AC voltage and a secondary winding connected between said two filars and the second AC transformer has a primary winding connected to said same two filars and a secondary winding adapted to be connected to said at least one electrode.

9. A circuit as in claim 3 which includes at least one additional filar in the RF transformer secondary winding.

10. A circuit as in claim 9 in which an AC transformer is center tapped and the additional filar is connected to the center tap of said AC transformer.

11. A circuit as in claim 10 in which said additional filar is adapted to be connected to a DC voltage source.

12. A circuit as in claim 3, wherein the first AC transformer is center tapped and said center tap of said first AC transformer is connected to RF "ground".

13. A circuit as in claim 12 wherein said center tap of said first AC transformer is bypassed to RF "ground" via a RF bypass capacitor.

14. A circuit as in claim 1, wherein said two filars are driven with a differential source of AC.

15. A circuit as in claim 1, wherein said at least two filars are terminated with a low impedance source.

16. A circuit as in claim 1, for use in an apparatus trapping, guiding or manipulating ions.

17. A circuit for applying RF and AC voltages to a linear multipole device of the type having at least two pairs of opposing linear rod electrodes comprising:

a RF transformer having a primary winding adapted to be connected to a source of RF voltage, a secondary winding coupled to said primary winding, said secondary winding comprising a first section having at least two filars, and said secondary winding having a low-voltage end and a high-voltage end, a second section having a low-voltage end adapted to be connected to the low-voltage end of one of said filars, and a high-voltage end adapted to be connected to one pair of said electrodes to apply RF voltage thereto, and an AC transformer adapted to be connected to an AC voltage supply, and the output of said AC transformer adapted to be connected between two filars of the first section of said secondary winding of the RF transformer at the low-voltage end, the high-voltage end of said two filars supplying a differential AC voltage between and a common RF voltage to at least one pair of said electrodes.

18. A circuit as in claim 17, wherein said AC transformer is a broadband transformer.

19. A circuit as in claim 18 in which said first broadband transformer has a primary winding for connection to a source of AC voltage and a secondary winding connected between said two filars and the output broadband transformer has a primary winding connected to said same two filars at the high voltage connection point of said first section of the RF transformer secondary winding and a secondary winding adapted to be connected to said pairs of electrodes.

20. A circuit as in claim 17, further comprising an output broadband AC transformer connected to the high voltage end of said two filars of the first section of said secondary winding of the RF transformer.

21. A circuit as in claim 18 or 20 in which at least one of the broadband transformers is an auto-transformer.

22. A circuit as in claim 17 which includes at least one additional filar on the secondary winding of the first section of said secondary winding of the RF transformer.

23. A circuit as in claim 17 in which the AC transformer is center tapped and the additional filar is connected to the center tap of said AC transformer.

24. A circuit for driving electrodes of a linear quadrupole ion trap of the type having a center section and two end sections, each including two pairs of spaced electrodes comprising:

a RF transformer having a primary winding adapted to be connected to a source of RF voltage and adapted to be a center-tapped secondary multi-filar winding coupled to said primary winding, said secondary windings comprising a first section having at least three filars having a low-voltage connection point and a high-voltage connection point, and a second section having at least three filars which have a low-voltage end adapted to be connected to corresponding filars at the low-voltage connection point of the first section and a high-voltage connection point, each filar adapted to be connected to one pair of each of said electrodes in each of said center and two end sections to apply RF voltage to said electrodes, a broadband transformer connected to apply AC voltage between two filars of the first winding section at the low-voltage connection point of said winding, an output broadband transformer with its primary winding connected to the high voltage connection point of said two filars of the first section, a third AC transformer, having a primary winding for receiving the output of said output broadband transformer, and three secondary windings, each one connected between one pair of the spaced electrodes of each of said center and two end sections for applying RF and AC voltages thereto.

25. A circuit as in claim 24 in which said first section and second section of the RF transformer include three additional filars with a different one of said filars adapted to connect a different DC voltage to each pair of electrodes in each of said center section and end sections.

26. A circuit as in claim 25 in which the additional filars are center tapped to connect to respective center taps of secondary windings of the third AC transformer.

27. A circuit for driving electrodes of a RF quadrupole linear ion trap of the type having at least a center section and two end sections, each including two pairs of spaced electrodes comprising:

an RF transformer having a primary winding adapted to be connected to a source of RF voltage and a multi-filar center-tapped secondary winding coupled to said primary winding, said secondary winding comprising a first section having at least three filars having a low-voltage end and a high-voltage end, and a second section having at least three filars which have a low-voltage end connected to the low-voltage end of the first section and a high-voltage end, each filar adapted to be connected to each of said center and two end sections in one pair of each of said electrodes;

a broadband transformer connected to apply AC voltage between two filars of the first winding section at the low-voltage end of said windings; and output broadband transformer means connected to said two filars at the high voltage end of said first section to apply RF and AC voltages to the other pair of each of said electrodes in each of said center and two end sections.

28. A circuit as in claim 27 in which said first section and second section include three filars with a different one of said filars adapted to connect to apply a different DC voltage to each pair of electrodes in each of said center section and end sections.

* * * * *